US006132558A

United States Patent [19]

Dyllick-Brenzinger et al.

[11] Patent Number: 6,132,558

[45] Date of Patent: Oct. 17, 2000

[54] PROCESS FOR PRODUCING PAPER AND CARDBOARD

[75] Inventors: Rainer Dyllick-Brenzinger, Weinheim; Hubert Meixner, Ludwigshafen; Friedrich Linhart, Heidelberg; Dietmar Mönch, Weinheim; Klaus-Dieter Gerber, Ludwigshafen; Bernd Dirks, Hessheim; Peter Baumann, Böhl-Iggelheim, all of Germany

[73] Assignee: BASF Aktiengesellschaft, Ludwigshafen, Germany

[21] Appl. No.: 09/147,486

[22] PCT Filed: Jul. 7, 1997

[86] PCT No.: PCT/EP97/03574

§ 371 Date: Jan. 8, 1999

§ 102(e) Date: Jan. 8, 1999

[87] PCT Pub. No.: WO98/01623

PCT Pub. Date: Jan. 15, 1998

[30] Foreign Application Priority Data

Jul. 9, 1996 [DE] Germany ..... 196 27 553

[51] Int. Cl.[7] ..... D21H 21/10

[52] U.S. Cl. ..... 162/164.6; 162/168.2; 162/168.3; 162/175; 162/181.6; 162/181.8; 162/183

[58] Field of Search ..... 162/164.6, 168.2, 162/164.1, 168.3, 183, 175, 181.6, 181.8

[56] References Cited

U.S. PATENT DOCUMENTS

| | | | |
|---|---|---|---|
| 4,421,602 | 12/1983 | Mueller et al. . | |
| 4,913,775 | 4/1990 | Langley et al. | 162/164.6 |
| 5,145,559 | 9/1992 | Auhorn et al. | 162/164.6 |
| 5,501,774 | 3/1996 | Burke | 162/168.2 |
| 5,876,563 | 3/1999 | Greenwood | 162/168.2 |

FOREIGN PATENT DOCUMENTS

| | | | |
|---|---|---|---|
| 0 071 050 | 7/1982 | European Pat. Off. . | |
| WO 94/26972 | 11/1994 | WIPO | 162/168.2 |

*Primary Examiner*—Peter Chin
*Attorney, Agent, or Firm*—Oblon, Spivak, McClelland, Maier & Neustadt, P.C.

[57] ABSTRACT

Paper and cardboard are produced by draining pulps, with sheet formation and drying of the sheets, by a process in which first (a) polyethyleneimines having a molar mass $M_w$ of more than 500,000 or polymers containing vinylamine units and having a molar mass of from 5000 to 3 million and then (b) cationic polyacrylamides or polymers containing vinylamine units, the molar masses $M_w$ of the polymers each being at least 4 million, are added to the pulps, and the pulp is then subjected to at least one shearing stage and is flocculated by adding bentonite, colloidal silica or clay.

10 Claims, No Drawings

PROCESS FOR PRODUCING PAPER AND CARDBOARD

BACKGROUND OF THE INVENTION

1. Field of the Invention

The present invention relates to a process for the production of paper and cardboard by draining pulps, with sheet formation and drying of the sheets, two different water-soluble cationic polymers being added in succession to the pulps and the latter then being subjected to at least one shearing stage and then being flocculated by adding bentonite, colloidal silica or clay.

2. Description of the Background

The process described at the outset is disclosed in EP-A-0 335 575. In this process, first a low molecular weight, water-soluble, cationic polymer and then a high molecular weight, water-soluble cationic polymer are added to the pulp. The low molecular weight water-soluble cationic polymers have a molar mass of less than 500,000. Suitable low molecular weight cationic polymers are, for example, polyethyleneimines, polyamines, polycyandiamide, formaldehyde condensates and polymers of diallyldimethylammonium chloride, dialkylaminoalkyl (meth)acrylates and dialkylaminoalkyl(meth)acrylamides. The suitable high molecular weight cationic polymers have molar masses of more than 500,000. These polymers are high molecular weight retention aids usually used in papermaking, such as cationic polyacrylamides. After the addition of the cationic polymers, the flocculated fiber suspension is subjected to a shearing stage, for example in a pulper, refiner, wire or screen, the hard giant flocks present in the paper stock being destroyed. Bentonite, colloidal silica or clay is then added, with the result that the destroyed flock constituents are collected by adsorption to give a soft microflock. It is only thereafter that the draining of the pulp with sheet formation on a wire and drying of the sheets are carried out.

EP-A-0 235 893 discloses a process for the production of paper and cardboard, more than 0.03% by weight, based on the dry weight of the suspension, of an essentially linear synthetic cationic polymer having a molar mass of more than 500,000 first being added to an aqueous fiber suspension, the mixture then being subjected to shearing in a shear field with formation of microflocks, from 0.03 to 0.5% by weight of bentonite then being metered and the pulp thus obtained being drained.

EP-A 0 223 223 discloses a process for the production of paper and cardboard by draining a paper stock, (a) from 0.1 to 2% by weight, based on dry paper stock, of an activated bentonite being added to a paper stock having a consistency of from 2.5 to 5% by weight, the consistency then being brought to 0.3–2% by weight by diluting with water, (b) from 0.01 to 0.1% by weight, based on dry paper stock, of a cationic polyelectrolyte having a charge density of at least 4 meq per g of polyelectrolyte then being added, (c) a high molecular weight polymer based on acrylamide or methacrylamide then being metered into the mixture, and the pulp thus obtained being drained after thorough mixing.

It is an object of the present invention further to increase the drainage rate and hence the rate of production in papermaking.

This object is achieved, according to the invention, by a process for the production of paper and cardboard by draining pulps, with sheet formation and drying of the sheets, two different water-soluble, cationic polymers being added in succession to the pulps and the latter then being subjected to at least one shearing stage and then being flocculated by adding bentonite, colloidal silica or clay, if first a) polyethyleneimines having a molar mass $M_w$ of more than 500,000 or polymers containing vinylamine units and having a molar mass $M_w$ of from 5000 to 3 million and then b) cationic polyacrylamides, cationic starch or polymers containing vinylamine units, the molar masses $M_w$ of the polymers each being at least 4 million, are used as water-soluble cationic polymers.

Unexpectedly, the use of polyethyleneimines having a molar mass $M_w$ of more than 500,000 or of polymers containing vinylamine units and having a molar mass $M_w$ of from 5000 to 3 million as cationic polymers of group a), which are initially added to the paper stock, leads to an increase in the drainage rate compared with the prior art, according to which polyethyleneimines having a molar mass of less than 500,000 are used.

According to the invention, suitable polymers of group a) are polyethyleneimines having a molar mass $M_w$ of more than 500,000, preferably more than 700,000. The polymers can be used in the form of the free bases or as salts with organic or inorganic acids in papermaking. Polyethyleneimines having such a high molar mass are prepared by polymerizing ethyleneimine in aqueous solution in the presence of acidic catalysts by known processes. Products of this type are commercially available. They usually have a broad molar mass distribution. Those polyethyleneimines which are obtainable as retentate by ultrafiltration of the suitable polyethyleneimines are particularly effective. In the ultrafiltration using membranes having cut-offs of at least 500,000, for example, from 5 to 40% by weight of the polyethyleneimine used is separated off as permeate.

Further suitable polymers of group a) are polymers containing vinylamine units and having a molar mass $M_w$ of from 5000 to 3 million. Polymers of this type are obtainable by polymerizing N-vinylformamide in the presence or absence of other monomers copolymerizable therewith and then partially or completely hydrolyzing the polymers by eliminating the formyl group from the polymerized vinylformamide units with formation of vinylamine units. Partially hydrolyzed homopolymers of N-vinylformamide are disclosed, for example, in EP-B-0 071 050. The partially hydrolyzed homopolymers of N-vinylformamide which are described therein contain vinylamine and N-vinylformamide units in polymerized form. In addition to the partially hydrolyzed poly-N-vinylformamides described in the stated publication, polymers in which the degree of hydrolysis is up to 100% are, according to the invention, suitable as component a).

Further suitable polymers of component a) which contain vinylamine units are the hydrolyzed copolymers of N-vinylformamide which are disclosed in EP-B-0 216 387. They are obtainable by, for example, copolymerizing N-vinylformamide with other monoethylenically unsaturated monomers and then partially or completely hydrolyzing the copolymers. The hydrolysis is effected in the presence of acids or bases or enzymatically. Vinylamine units are formed from the polymerized N-vinylformamide units in the hydrolysis by elimination of formyl groups. Suitable comonomers are, for example, vinyl formate, vinyl acetate, vinyl propionate, $C_1$- to $C_6$-alkyl vinyl ethers, monoethylenically unsaturated $C_3$- to $C_8$-carboxylic acids, their esters, nitriles and amides and, where obtainable, also the anhydrides, N-vinylurea, N-vinylimidazoles and N-vinylimidazolines. If the copolymers contain carboxylic acids in the form of polymerized units, the hydrolysis of the N-vinylformamide groups gives amphoteric copolymers whose content of vinylamine units is greater than that of polymerized units of ethylenically unsaturated carboxylic acids, so that these copolymers carry an excess cationic charge.

Examples of ethylenically unsaturated carboxylic acids are acrylic acid, methacrylic acid, dimethylacrylic acid, ethacrylic acid, crotonic acid, vinylacetic acid, allylacetic acid, maleic acid, fumaric acid, citraconic acid and itaconic acid and each of their esters, anhydrides, amides and nitriles. Preferably used anhydrides are, for example, maleic anhydride, citraconic anhydride and itaconic anhydride.

Suitable comonomers for the copolymerization with N-vinylformamide are esters which are preferably derived from alcohols of 1 to 6 carbon atoms, such as methyl acrylate, methyl methacrylate, ethyl acrylate, ethyl methacrylate, isobutyl acrylate or hexyl acrylate, or glycols or polyalkylene glycols, in each case only one OH group of the glycols or polyglycols being esterified with a monoethylenically unsaturated carboxylic acid, e.g. hydroxyethyl acrylate, hydroxyethyl methacrylate, hydroxypropyl acrylate, hydroxypropyl methacrylate, hydroxybutyl acrylate and hydroxybutyl methacrylate. Other suitable comonomers are esters of ethylenically unsaturated carboxylic acids with aminoalcohols, e.g. dimethylaminoethyl acrylate, dimethylaminoethyl methacrylate, diethylaminoethyl acrylate, diethylaminoethyl methacrylate, dimethylaminopropyl acrylate and dimethylaminopropyl methacrylate. Preferred amides are acrylamide and methacrylamide. The basic acrylates may be used in the form of the free bases or of the salts with mineral acids or carboxylic acids or in quaternized form in the copolymerization with N-vinylformamide. Further suitable comonomers are acrylonitrile, methacrylonitrile, N-vinylimidazole and substituted N-vinylimidazoles, such as N-vinyl-2-methylimidazole and N-vinyl-2-ethylimidazole, N-vinylimidazoline and substituted N-vinylimidazolines such as N-vinyl-2-methylimidazoline. Other suitable ethylenically unsaturated comonomers are sulfo-containing monomers, such as vinylsulfonic acid, allylsulfonic acid, styrenesulfonic acid and 3-sulfopropyl acrylate. The monomers containing acid groups can be used in the form of the free acids or as alkali metal or ammonium salts in the copolymerization with N-vinylformamide.

In order to prepare low molecular weight polymers, the polymerization is expediently carried out in the presence of regulators. Suitable regulators are, for example, organic compounds containing sulfur in bound form. These include, for example, mercapto compounds, such as mercaptoethanol, mercaptopropanol, mercaptobutanol, mercaptoacetic acid, mercaptopropionic acid, butyl mercaptan and dodecyl mercaptan. Other suitable regulators are allyl compounds, such as allyl alcohol, aldehydes, such as formaldehyde, acetaldehyde, propionaldehyde, n-butyraldehyde and isobutyraldehyde, formic acid, ammonium formate, propionic acid, hydrazine sulfate and butenols. If the polymerization is carried out in the presence of regulators, preferably from 0.05 to 20% by weight, based on the monomers used in the polymerization, are employed.

The polymerization of the monomers is usually carried out in an inert gas atmosphere in the absence of atmospheric oxygen. During the polymerization, thorough mixing of the reactants is generally ensured. In the case of relatively small batches where safe removal of the heat of polymerization is ensured, the monomers can be copolymerized batchwise by heating the reaction mixture to the polymerization temperature and then allowing reaction to take place. These temperatures are, for example, from 40 to 180° C., it being possible to employ atmospheric, reduced or superatmospheric pressure. Polymers having a high molecular weight are obtained if the polymerization is carried out in water. This can be effected, for example, for the preparation of water-soluble polymers in aqueous solution, as water-in-oil emulsion or by the reverse suspension polymerization method. To avoid hydrolysis of N-vinylformamide during the polymerization in aqueous solution, the polymerization is preferably carried out at a pH of from 4 to 9, in particular from 5 to 8. In many cases, it is advisable additionally to operate in the presence of buffers, for example primary or secondary sodium phosphate being used as the buffer.

The homo- or copolymers of N-vinylformamide are subjected to hydrolysis with acids, bases or enzymes in a second stage in a polymer-analogous reaction. Suitable acids are, for example, mineral acids, such as hydrogen halide (gaseous or in aqueous solution), sulfuric acid, nitric acid or phosphoric acid, and organic acids, such as $C_1$- to $C_5$-carboxylic acids, e.g. formic acid, acetic acid and propionic acid, or the aliphatic or aromatic sulfonic acids, such as methanesulfonic acid, benzenesulfonic acid or toluenesulfonic acid. Hydrochloric acid or sulfuric acid is preferably used for the hydrolysis. In the hydrolysis with acids, the pH is from 0 to 5. For example, from 0.05 to 1.5, preferably from 0.4 to 1.2, equivalents of an acid are required per equivalent of formyl groups in the polymer.

In the hydrolysis with bases, hydroxides of metals or of the first and second main groups of the Periodic Table may be used; for example, lithium hydroxide, sodium hydroxide, potassium hydroxide, magnesium hydroxide, calcium hydroxide, strontium hydroxide and barium hydroxide are suitable. However, ammonia and alkyl derivatives of ammonia, for example alkylamines or arylamines, such as triethylamine, monoethanolamine, diethanolamine, triethanolamine, morpholine or aniline, may also be used. In the hydrolysis with bases, the pH is from 8 to 14. The bases may be used in the solid, liquid or, if required, gaseous state, dilute or undiluted. Preferably used bases for the hydrolysis are ammonia, sodium hydroxide solution or potassium hydroxide solution. The hydrolsis at alkaline and acidic pH is generally effected at, for example, from 30 to 170° C., preferably from 50 to 120° C. It is complete after from about 2 to 8, preferably from 3 to 5, hours. After the hydrolysis, the reaction mixture is preferably neutralized so that the pH of the hydrolyzed polymer solution is from 2 to 8, preferably from 3 to 7. Neutralization is necessary in particular when a continuation of the hydrolysis is to be avoided or delayed.

In the hydrolysis of copolymers of N-vinylformamide, a further modification of the polymers may occur by virtue of the fact that the comonomers incorporated as polymerized units are also hydrolyzed. For example, vinyl alcohol units are formed from polymerized units of vinyl esters. Depending on the hydrolysis conditions, the vinyl esters incorporated as polymerized units may be completely or partially hydrolyzed. In the case of partial hydrolysis of N-vinylformamide copolymers containing polymerized vinyl acetate units, the hydrolyzed copolymer contains vinyl alcohol units and vinylamine and N-vinylformamide units in addition to unchanged vinyl acetate units. Carboxylic acid units are formed from units of monoethylenically unsaturated carboxylic anhydrides in the hydrolysis. Monoethylenically unsaturated carboxylic acids incorporated as polymerized units are not chemically changed in the hydrolysis. On the other hand, ester and amide units are hydrolyzed to carboxylic acid units. Units of amides or carboxylic acids are formed from monoethylenically unsaturated nitriles incorporated as polymerized units. Vinylamine units may likewise be formed from N-vinylurea incorporated as polymerized units. The degree of hydrolysis of the comonomers incorporated as polymerized units can be readily determined by analysis.

Polymers which contain polymerized 1) vinylamine units and
2) N-vinylformamide, vinyl formate, vinyl acetate, vinyl propionate, vinyl alcohol and/or N-vinylurea units are preferably used as polymers of component a) which contain vinylamine units. Polymers preferably to be used contain 1) from 10 to 100, preferably from 20 to 100, mol % of vinylamine units and
2) from 0 to 90, preferably from 0 to 80, mol % of N-vinylformamide units.

These copolymers are either partially or completely hydrolyzed hompolymers of N-vinylformamide. Hydrolyzed copolymers of N-vinylformamide contain, for example, from 10 to 90, preferably from 20 to 70, mol % of vinylamine units and from 10 to 90, preferably from 30 to 80, mol % of other monoethylenically unsaturated monomers.

Polymers a) and b) are each added in the amount of from 0.001 to 0.8% by weight based on the weight of dry pulp.

The polymers containing vinylamine units have a molar mass $M_w$ of from 5000 to 3 million, preferably from 20,000 to 2 million. The partially or completely hydrolyzed polymers of N-vinylformamide have a charge density of from 4 to 18, preferably from 8 to 18, meq/g (determined at pH 7). The polymers of group a) are used in amounts of from 0.01 to 0.8, preferably from 0.01 to 0.5% by weight in the novel process.

Polymers of group b) are, for example, cationic polyacrylamides having molar masses $M_w$ of at least 4 million. Polymers of this type are described in EP-A-335 575 stated in connection with the prior art. They are commercially available. The high molecular weight cationic polyacrylamides are prepared by polymerizing 40 acrylamide with cationic monomers. Suitable cationic monomers are, for example, the esters of ethylenically unsaturated $C_3$- to $C_5$-carboxylic acids with aminoalcohols, such as dimethylaminoethyl acrylate, diethylaminoethyl acrylate, dimethylaminoethyl methacrylate, diethylaminoethyl methacrylate and di-n-propylaminoethyl acrylate. Further suitable cationic monomers which may be copolymerized with acrylamide are N-vinylimidazole, N-vinylimidazoline and basic acrylamides, such as dimethylaminoethylacrylamide. The basic monomers may be used in the form of the free bases, as salts or in quaternized form in the copolymerization. The cationic polyacrylamides contain, for example, from 5 to 40, preferably from 10 to 40,% by weight of cationic monomers in polymerized form. The molar masses $M_w$ of the cationic polyacrylamides are at least 4,000,000 and in most cases above 5,000,000, for example from 5,000,000 to 15,000,000.

Further suitable cationic polymers of group b) are polymers which 10 contain vinylamine units and have molar masses of at least 4,000,000. Polymers containing vinylamine units have been described above. The polymers containing vinylamine units and suitable here as component b) differ from those of group a) in that they have a higher molar mass. These polymers are preferably completely or partially hydrolyzed homopolymers of N-vinylformamide. Hydrolyzed copolymers of N-vinylformamide with vinyl formate, vinyl acetate, vinyl propionate, acrylic acid, methacrylic acid, N-vinylpyrrolidone and N-vinylcaprolactam are also suitable. Copolymers of N-vinylformamide and ethylenically unsaturated carboxylic acids are amphoteric after hydrolysis but always have an excess of cationic charge. The polymers preferably contain up to not more than 40% by weight of polymerized vinylamine units. Particularly preferably used polymers are those which contain from 10 to 35% by weight of vinylamine units. The polymers of group b) which contain vinylamine units preferably have a charge density of, for example, from 0.5 to 7 milliequivalents per gram at pH 7. They are added to the paper stock in amounts of from 0.005 to 0.5, preferably from 0.01 to 0.2,% by weight.

All paper grades and cardboard, for example papers for newsprint, i.e. medium writing and printing papers, natural gravure papers and also lightweight coating papers, can be produced according to the novel process. For example, groundwood, thermomechanical pulp (TMP), chemothermomechanical pulp (CTMP), pressure groundwood (PGW) and sulfite and sulfate pulp can be used. Chemical pulp and mechanical pulp are also suitable as raw materials for the production of the pulps. These pulps are therefore processed to paper especially in the integrated mills, in more or less moist form, directly without prior thickening or drying. Because the impurities have not been completely removed therefrom, these fiber materials still contain substances which greatly interfere with the usual papermaking process. In the novel process, however, pulps containing interfering substances can also be directly processed.

In the novel process, both filler-free and filler-containing paper can be produced. The filler content of paper may be up to a maximum of 40, preferably from 5 to 25% by weight. Suitable fillers are, for example, clay, kaolin, natural and precipitated chalk, titanium dioxide, talc, calcium sulfate, barium sulfate, alumina, satin white or mixtures of the stated fillers.

The consistency of the pulp is, for example, from 0.1 to 15% by weight. At least one cationic polymer of group a) is first added to the fiber suspension, followed by at least one cationic polymer of group b). This addition results in considerable flocculation of the paper stock. The hard giant flocks present in the flocculated system are destroyed in at least one subsequent shearing stage, which may consist, for example, of one or more purification, mixing and pumping stages or of a pulper, screen, refiner or wire, through which the preflocculated paper stock is passed. After the shearing stage, bentonite, colloidal silica or clay is added, with the result that soft microflocks are formed. The amounts of bentonite, colloidal silica or clay are from 0.01 to 2, preferably from 0.05 to 0.5% by weight, based on the dry paper stock. Bentonite is a sheet aluminum silicate based on montmorillonite, which occurs naturally. It is generally used after replacement of the calcium ions by sodium ions. For example, bentonite is treated in aqueous suspension with sodium hydroxide solution. It thus becomes fully swellable in water and forms highly viscous thixotropic gel structures. The lamella diameter of the bentonite is, for example, from 1 to 2 $\mu$m and the lamella thickness about 10 Å. Depending on type and activation, bentonite has a specific surface area of from 60 to 800 $m^2/g$. Owing to the large internal surface area and the external excess negative charges at the surface, such inorganic polyanions can be used for adsorptive collecting effects in paper stocks converted to cationic charge and subjected to a shear treatment. Optimum flocculation in the paper stock is thus achieved. With the cationic monomers of groups a) and b) which are used according to the invention, another improvement in the drainage rate of paper stocks, in particular of paper stocks which contain interfering substances, for example humic acids, wood extract or ligninsulfonates, is surprisingly achieved compared with the prior art.

In the Examples which follow, the percentages are by weight unless otherwise evident from the context. The molar masses $M_w$ were determined by the static light scattering method. The paper sheets were produced in a Rapid-Köthen sheet former. The optical transmittance of the white water was determined with a Dr. Lange spectrometer at 588 nm. The drainage times stated in the Examples were determined in each case for 500 ml of filtrate in a Schopper-Riegler tester.

For comparison, the paper stock was tested in the absence of polymers (Comparative Example 1.1) and in the presence of polymer 6 and bentonite (Comparative Example 1.2) and, according to EP-A-0 335 575, in the presence of polymer 5 (Comparative Example 1.3). The results are summarized in Table 2.

TABLE 2

| | Addition of cationic polymer of the type | | | | Shearing stage after polymer | Bentonite | Drainage time | optical transmittance |
|---|---|---|---|---|---|---|---|---|
| | (a) in [%] | | (b) in [%] | | addition | [%] | [sec] | [%] |
| Example | | | | | | | | |
| 1a) | Polymer 1 | 0.025 | Polymer 6 | 0.025 | + | 0.2 | 22 | 86 |
| 1b) | Polymer 2 | 0.025 | Polymer 6 | 0.025 | + | 0.2 | 29 | 84 |
| 1c) | Polymer 3 | 0.025 | Polymer 6 | 0.025 | + | 0.2 | 26 | 88 |
| 1d) | Polymer 4 | 0.025 | Polymer 6 | 0.025 | + | 0.2 | 31 | 85 |
| Comp. Example | | | | | | | | |
| 1.1 | — | — | — | — | | — | 61 | 29 |
| 1.2 | — | — | Polymer 6 | 0.025 | + | 0.2 | 47 | 67 |
| 1.3 | Polymer 5 | 0.025 | Polymer 6 | 0.025 | + | 0.2 | 36 | 80 |

EXAMPLES

The following polymers were used

TABLE 1

| Polymer No. | Composition | Molar mass $M_W$ | Charge density at pH 7 [meq/g] |
|---|---|---|---|
| Polymer 1 | Polyethyleneimine | 1 million | 15 |
| Polymer 2 | Polyethyleneimine | 1 million | 11 |
| Polymer 3 | Polyvinylamine | 300,000 | 16.5 |
| Polymer 4 | Polyvinylamine | 300,000 | 6 |
| Polymer 5 | Commercial Polymin ® SK[1)] | — | 6.5 |
| Polymer 6 | Copolymer of 70% by weight of acrylamide and 30% by weight of dimethylaminoethyl acrylate quaternized with $CH_3Cl$ | 5 million | 1.7 |

[1)]modified polyethyleneimine

Example 1

A pulp having a consistency of 5.9 g/l was prepared from 40% of TMP (thermomechanical pulp), 40% of bleached pine sulfate having a freeness of 40 degrees SR (Schopper-Riegler) and 20% of coated broke (coating shop waste). The pH of the pulp was 7.6. The paper stock was divided into several samples, to which the polymers stated in Table 2 were added according to Examples a) to d). After the addition of the polymers 2 to 5 to the paper stock, the mixture was stirred and cationic polymer 6 was then added in the amounts likewise stated in Table 2. Each pulp was then subjected to shearing for 1 minute by stirring at a speed of 1500 rpm. 0.2%, based on dry paper stock, of bentonite was then added and the drainage time for 500 ml of filtrate in each case was determined for each sample in a Schopper-Riegler tester, as well as the optical transmittance of the white water. The results are shown in Table 2.

Example 2

A pulp having a consistency of 6.1 g/l and a freeness of 500 SR was prepared from 100 parts of unprinted newsprint having a filler content of about 10% and 10 parts of Chinaclay (Type X1 from ECC). The pH of the pulp was 7.6. The paper stock was divided into several samples and drained under the conditions stated in Table 3, in a Schopper-Riegler tester. In each case, first the polymers a) and then the polymers b) were metered in. The paper stock was then subjected to a shearing stage by stirring it for 1 minute at 1500 rpm. The bentonite was then metered, and the drainage time and optical transmittance were determined. The results are shown in Table 3.

For comparison, a sample of the paper stock described above was drained without any addition (Comparative Example 2.1). In Comparative Examples 2.2 and 2.3, the paper stock was subjected to shearing for one minute at 1500 rpm after the addition of first the polymer of type a) and then the polymer of type b), after which bentonite was added and drainage was carried out in the Schopper-Riegler tester. The results are shown in Table 3.

TABLE 3

| | Addition of in each case 0.025% of cationic polymer of the type | | Shearing stage after polymer | Bentonite | Drainage time | Optical transmittance |
|---|---|---|---|---|---|---|
| | (a) | (b) | addition | [%] | [sec.] | [%] |
| Ex. | | | | | | |
| 2a) | Polymer 1 | Polymer 6 | + | 0.2 | 29 | 80 |
| 2b) | Polymer 2 | " | + | 0.2 | 28 | 82 |
| 2c) | Polymer 3 | " | + | 0.2 | 29 | 78 |
| 2d) | Polymer 4 | " | + | 0.2 | 25 | 83 |

TABLE 3-continued

| | Addition of in each case 0.025% of cationic polymer of the type | | Shearing stage after polymer | Bentonite | Drainage time | Optical transmittance |
|---|---|---|---|---|---|---|
| | (a) | (b) | addition | [%] | [sec.] | [%] |
| Comp. Ex. | | | | | | |
| 2.1 | — | — | | — | 95 | 33 |
| 2.2 | — | Polymer 6 | + | 0.2 | 48 | 55 |
| 2.3 | Polymer 5 | " | + | 0.2 | 32 | 79 |

ke

Example 3

A pulp having a consistency of 6 g/l and a freeness of 500 SR was prepared from 100 parts of printed newsprint. The pH of the pulp was 7.6. The pulp was divided into several samples. In the Examples according to the invention, first the cationic polymer of type a) and then the cationic polymer according to b) were metered. The pulps were then each stirred for 1 minute with a stirrer at a speed of 1500 rpm. 0.2%, based on dry paper stock, of bentonite was then added, and the drainage time was determined in a Schopper-Riegler tester. The optical transmittance of the white water was also determined.

In Comparative Example 3.1, the drainage time and the optical transmittance of the white water of the pulp were determined without any further addition. In Comparative Example 3.2, the pulp was subjected to a shearing stage after the addition of polymer 6, after which bentonite was added and drainage carried out. In Comparative Example 3.3, the polymers stated there were added as in Example 3a). After the pulp had been subjected to shearing, bentonite was added and the drainage time and optical transmittance were determined. The results obtained in the Examples and Comparative Examples are shown in Table 4.

| | Addition of in each case 0.025% of cationic polymer of type | | Shearing stage after polymer | Bentonite | Drainage time | Optical transmittance |
|---|---|---|---|---|---|---|
| | (a) | (b) | addition | [%] | [sec.] | [%] |
| Ex. | | | | | | |
| 3a) | Polymer 1 | Polymer 6 | + | 0.2 | 58 | 62 |
| 3b) | Polymer 2 | Polymer 6 | + | 0.2 | 58 | 62 |
| 3c) | Polymer 3 | Polymer 6 | + | 0.2 | 51 | 67 |
| 3d) | Polymer 4 | Polymer 6 | + | 0.2 | 59 | 68 |
| Comp. Ex. | | | | | | |
| 3.1 | — | — | | — | 132 | 22 |
| 3.2 | — | Polymer 6 | + | 0.2 | 82 | 51 |
| 3.3 | Polymer 5 | Polymer 6 | + | 0.2 | 63 | 62 |

We claim:

1. A process for the production of paper or cardboard or both, which comprises:

a) adding first and second water-soluble, cationic polymers in succession to pulp, wherein after the addition of the second water-soluble cationic polymer, the pulp is subjected to at least one shearing stage, and flocculating the mixture by adding a flocculating agent selected from the group consisting of bentonite, colloidal silica, and clay;

b) forming a sheet from the mixture of step a); and c) drying the sheet formed in step b);

wherein:

said first water-soluble cationic polymer is a polyethyleneimine having a molar mass, $M_w$, of more than 500,000, or a polymer containing vinylamine units and having a molar mass $M_w$, of from 5,000 to 3,000,000 added in an amount of 0.001 to 0.8% by weight based on the weight of dry pulp.

said second water-soluble cationic polymer is a cationic polyacrylamide, cationic starch, or polymer containing vinylamine units, the molar mass, $M_w$ of said polymer being at least 4,000,000 added in an amount of 0.001 to 0.8% weight based on the weight of dry pulp.

2. The process of claim 1, wherein said first water soluble cationic polymer is a polyethyleneimine having a molar mass of more than 700,000.

3. The process of claim 1, wherein said first water-soluble cationic polymer is a polymer containing vinylamine units having a molar mass of from 20,000 to 2,000,000.

4. The process of claim 1, wherein said second water-soluble cationic polymer is a cationic polyacrylamide having a molar mass of at least 5,000,000.

5. The process of claim 1, wherein said second water-soluble cationic polymer is a polymer containing from 10 to 35% by weight of vinylamine units, and having a molar mass of at least 5,000,000.

6. The process of claim 1, where said first water-soluble cationic polymer is used in an amount of from 0.01 to 0.5% by weight.

7. The process of claim 1, wherein said second water-soluble cationic polymer is used in an amount of from 0.01 to 0.2% by wt.

8. The process of claim 7, wherein said first water-soluble cationic polymer is a partially or completely hydrolyzed polymer of N-vinylformamide having a charge density of from 4 to 18 meq/g (determined at pH 7).

9. The process of claim 8, wherein said partially or completely hydrolyzed polymers of N-vinylformamide are homopolymers of N-vinylformanide having a charge density of from 8 to 18 meq/g (determined at pH 7).

10. The process of claim 1, wherein said second water-soluble cationic polymer is a polymer containing vinylamine units, and having therein not more than 40% by weight of vinylamine units, and having a charge security of from 0.5 to 7 meq/g (determined at pH7).

* * * * *